United States Patent [19]

Sato et al.

[11] Patent Number: 4,652,495

[45] Date of Patent: Mar. 24, 1987

[54] RESILIENT COAT FOR TIE OF DIRECT-CONNECTION TYPE TRACK

[75] Inventors: Yoshihiko Sato, Chiba; Fujio Ohishi, Akishima; Tatsuya Hongu, Tokyo; Toshio Suzuki, Tokyo; Yoshihiko Ogawa, Tokyo, all of Japan

[73] Assignees: Japanese National Railways; Nisshinbo Industries, Inc., both of Tokyo, Japan

[21] Appl. No.: 824,711

[22] Filed: Jan. 31, 1986

[51] Int. Cl.[4] ..... B32B 13/12; E01B 3/36; E01B 3/46

[52] U.S. Cl. ..... 428/425.5; 238/84; 248/634; 264/45.6; 428/315.5; 428/319.1; 521/176

[58] Field of Search ..... 238/84; 248/634; 521/176; 428/315.5, 319.1, 425.5; 264/45.6

[56] References Cited

U.S. PATENT DOCUMENTS

| | | | |
|---|---|---|---|
| 3,188,302 | 6/1965 | Lorenz et al. | 521/176 |
| 3,887,505 | 6/1975 | Demou et al. | 521/176 |
| 4,112,176 | 9/1978 | Bailey | 428/425.5 |
| 4,210,728 | 7/1980 | Patton et al. | 521/176 |
| 4,302,552 | 11/1981 | Hongu et al. | 521/176 |

*Primary Examiner*—James C. Cannon
*Attorney, Agent, or Firm*—Sherman and Shalloway

[57] ABSTRACT

A resilient coat for a direct connection-type tie (Danchoku tie) which is composed of a concrete tie body and a microcellular polyurethane elastomer coating layer which adheres to and coats the lower portion of the tie body to form an integral body therewith, and said microcellular polyurethane elastomer having urethane bonds and a bulk density of 0.4–0.75 g/cm$^3$ and being prepared from the starting foamable liquid of urethane elastomer composed substantially of (a) a polyether polyol having an average number of functional groups of 2.5–4.5 and a number average molecular weight of 2000–8500, (b) a vinyl monomer-grafted polyol having an average number of functional groups of 2.5–4.0, and the graft ratio of 4–20% by weight, (c) a liquid polybutadiene polyol having hydroxyl terminal group(s), an average number of functional groups of 2.0–3.0 and a number average molecular weight of 2000–7000, (d) an organic polyisocyanate, (e) a chain extender, (f) a blowing agent, and (g) a urethanation catalyst, at such ratios that the NCO index is within the range of 90–110, and the concentration of the chain extender, based on the total amount of the five components of (a), (b), (c), (d) and (e), being $0.3\times10^{-3}$ to $1.5\times10^{-3}$ mol/g.

23 Claims, 11 Drawing Figures

( SIDE ELEVATION )

FIG. 10B ( SECTIONAL VIEW )

RESILIENT COAT FOR TIE OF DIRECT-CONNECTION TYPE TRACK

Figure 1:
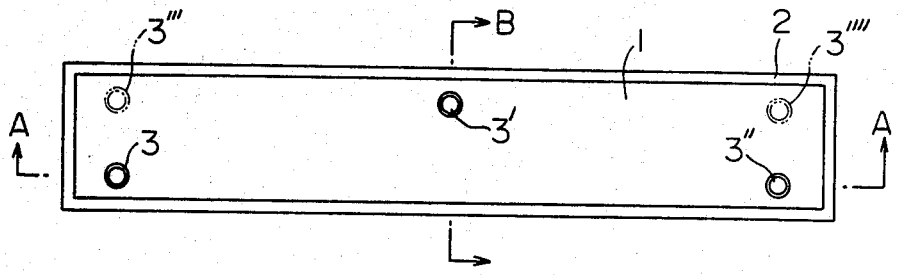

This invention relates to a tie for railway track. More specifically, the invention relates to a resilient coat for a direct-connection type tie composed of a concrete tie body for supporting rail ("Danchoku" tie) with its lower portion coated by a layer of a microcellular polyurethane elastomer which is adhered to the former to form an integral body, said Danchoku tie achieving easier maintenance and reduction in railway vibration and noise at the same time, and furthermore allowin laying of railway track with high precision and easy operation.

Due to mainly the demand for elimination or reduction of labor, the recent trend is that the conventional ballasted tie track is being replaced by direct-connection type track system such as one using track slab, which is easier of maintenance. In this direct-connection type track system, however, concrete slabs were directly laid on solid roadbed without using ballast and ballast-mat, and consequently there may be such drawbacks as increased railway vibration and noise compared with the case of using resilient ballasted track with ballast-mat.

Accordingly the development of a new system which is easier of maintenance and furthermore causes less railway vibration and noise has been demanded. To meet this demand, so-called "resilient coated tie", i.e., larger size concrete tie (namely, a track slab of reduced size) with its bottom and side surfaces coated with an elastomeric material, was proposed, and the so-called direct connection type resilient coated tie system was studied, with the view to reduce the vibration transmission and occurrence of noise, by laying such ties on concrete roadbed through a grout (for example, synthetic resin, grouting concrete, etc.).

As the elastomeric material to be used for the resilient coated tie, it was proposed in the past to use the product obtained through the steps of mixing the pulverized rubber obtained from used automobile tyres with a polyurethane adhesive, filling a mold with the mixture, pressing the latter with a compresser and aging the same under heating. However, preparation of such a resilient material requires much labor (production efficiency: one piece of the product per mold and per day) as well as large scale equipments, and besides, the adhesion of the resilient coating to concrete tie bodies is apt to become incomplete, occasionally causing peeling off. Furthermore, in case of laying the conventional resilient coated ties on concrete roadbed and burying and fixing them with grouting concrete in situ, the resilient material is almost completely bound to the concrete and prevented of free deformation. Hence, the spring constant increases, the vibration-isolating effect is reduced and the merit of using the resilient coat is lost.

Thus, in the system of burying and fixing ties in and on concrete roadbed using, for example, grouting concrete ("Danchoku" track) for reducing vibration and noise, the vibration-isolator coat is firmly confined by the grouting concrete and inhibited of free deformation, and for this reason the vibration isolator coat is required to still fully exhibit its vibration transmission-reducing effect and noise-reducing effect even under the free deformation-restricted condition, as strongly adhered to the tie bodies and without an increase in the spring constant.

The property requirements on the resilient-coating material for Danchoku ties to be used in railway track, on which many-coach trains run at high speeds, are still more rigorous, e.g., the following property ratings are required:

Permanent compression set: 15% or less
Spring constant: 0.2–2 tons/cm/100 $cm^2$
Tensile strength: 5 kg $f/cm^2$ or higher
Tensile elongation: 100% or more
Waterproffness
(variation of tensile strength): within ±20%
(variation of tensile elongation): within ±20%
Alkali resistance
(variation of tensile strength): within ±20%
(variation of tensile elongation): within ±20%
Fatigue resistance: amount of permanent deformation 1.0 mm or less.

It is required that the material should satisfy all of those requirements at the same time.

Furthermore, there is another important requirement that the resilient or elastomeric coating material must strongly adhere to the concrete tie bodies, never peeling off under the repetitive compression exerted by intermittent train running.

The present inventors discovered and proposed, as an elastomeric coating material fully satisfying these requirements, a microcellular urethane elastomer having a bulk density of 0.3–0.9 $g/cm^3$, which is prepared from a raw foaming liquid of urethane elastomer composed of a polyhydric alcohol having an average number of functional group of 2.5—3.5 and a number average molecular weight of about 4500–about 8500, an organic polyisocyanate, a chain-extending agent, a urethanation catalyst and a foaming agent, said raw liquid containing the chain-extending agent at a concentration of $0.2\times10^{-3}$ to $1.0\times10^{-3}$ mol/g per the unit weight of the urethane elastomer (Laid-open Gazette, Kokai No. 130754/1980).

This previously proposed microcellular urethane elastomer satisfies the foregoing ratings, and is actually used at the straight portions of high-speed railway track. It is only logical, however, that even with such elastomeric coating material composed of the microcellular urethane elastomer, it is preferred to reduce the cost of raw materials by further lowering the bulk density. Low bulk density however inevitably reduces the spring constant. At the curved portions of railway track, furthermore, the track is subject to particularly high centrifugal force and the elastomeric coating material is severely compressed. Consequently spaces are formed between the elastomeric coating material and the grouting concrete, and water and dust tend to go into said spaces. Therefore, it is insufficient to simply raise the degree of foaming of said microcellular urethane elastomer to reduce its bulk density. For example, there is a problem that if bulk density of the microcellular urethane elastomer is kept at not higher than 0.7 $g/cm^3$ and still the spring constant is to be maintained at around 1.0 tf/ cm/100 $cm^2$, the permanent compression set is increased.

Under the circumstances, an object of the present invention is to provide Danchoku ties of which elastomeric coating material is made of a microcellular polyurethane elastomer which, in spite of its low bulk density, shows no substantial increase in its permanent compression set.

Another object of the present invention is to provide Danchoku ties which enable very accurate and easy laying of Danchoku railway track, by boring plural through-holes for bolting which vertically pierce through the Danchoku ties inclusive of the elastomeric coating.

Still other object and advantages of the present invention will become apparent from the following detailed explanation of the invention.

According to the present invention, a resilient coated, direct connection-type tie (Danchoku tie) which is composed of a concrete tie body for supporting rail and a microcellular polyurethane elastomer coating layer which adheres to and coats the lower portion of the tie body to form an integral body therewith and is provided with two or more through-holes for bolting which vertically pierce through said tie body and coating layer, said tie body having buried in its through-holes the nuts screw-fittable with the bolts, and said microcelluar polyurethane elastomer having urethane bonds and a bulk density of 0.4–0.75 g/cm$^3$ and being prepared from the starting foamable liquid of urethane elastomer composed substantially of (a) a polyether polyol having an average number of functional groups of 2.5–4.5 and a number average molecular weight of 2000–8500,
(b) a vinyl monomer-grafted polyol having an average number of functional groups of 2.5–4.0, and the graft ratio of 4–20% by weight,
(c) a liquid polybutadiene polyol having hydroxyl terminal group(s), an average number of functional groups of 2.0–3.0 and a number average molecular weight of 2000–7000,
(d) an organic polyisocyanate,
(e) a chain extender,
(f) a blowing agent, and
(g) a urethanation catalyst, at such ratios that the NCO index is within the range of 90–110, and the concentration of the chain extender, based on the total amount of the five components of (a), (b), (c), (d) and (e), being $0.3\times10^{-3}$ to $1.5\times10^{-3}$ mol/g.

Hereinafter the tie involving present invention will be explained in further details, referring to the specific embodiments shown in the attached drawings.

Figure 2:
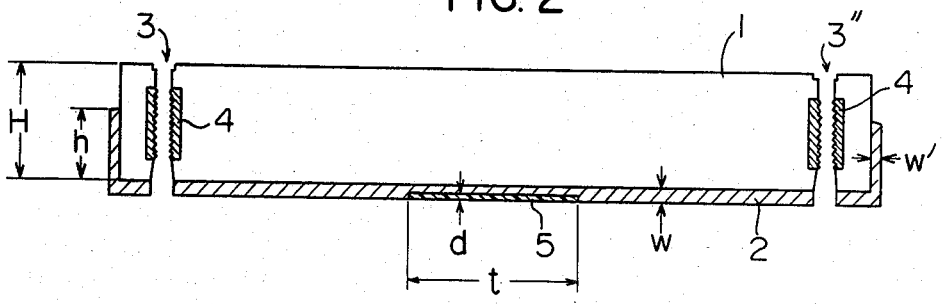
Figure 3:
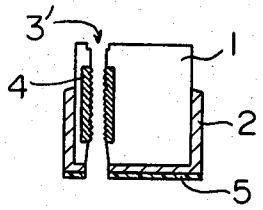
Figure 4:
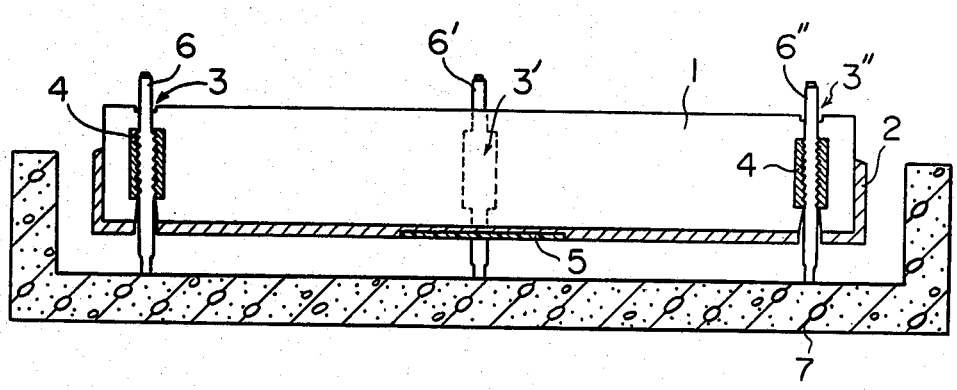
Figure 5:
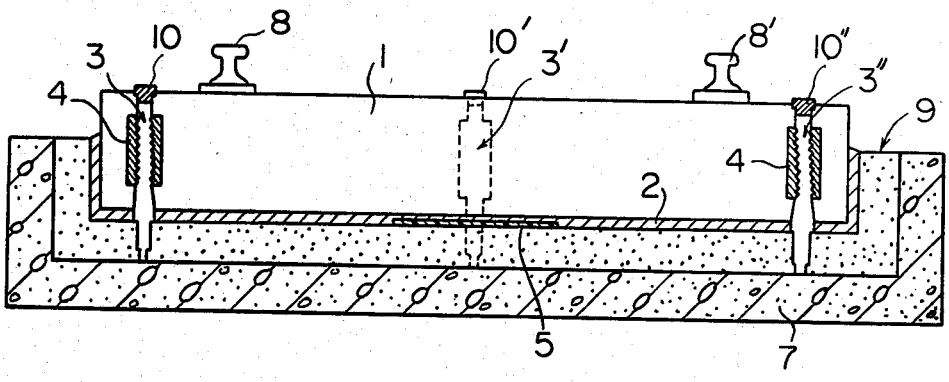
Figure 6:
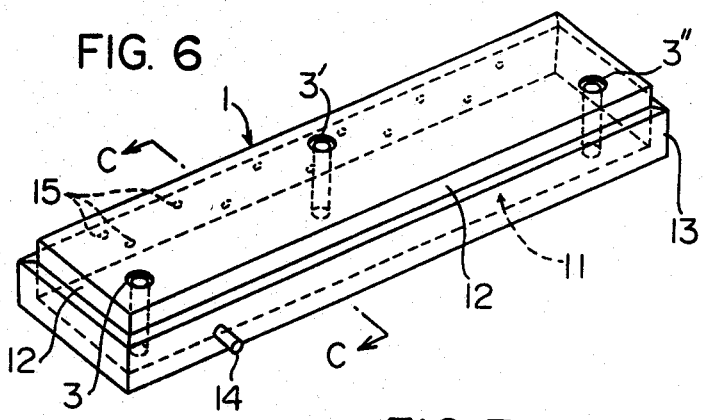
Figure 7:
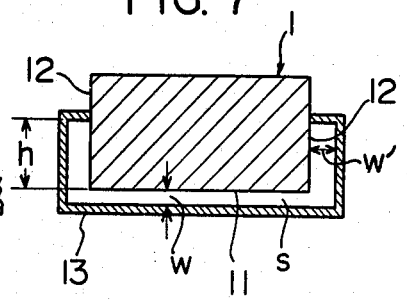
Figure 9:
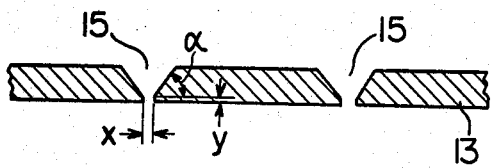
Figure 8:
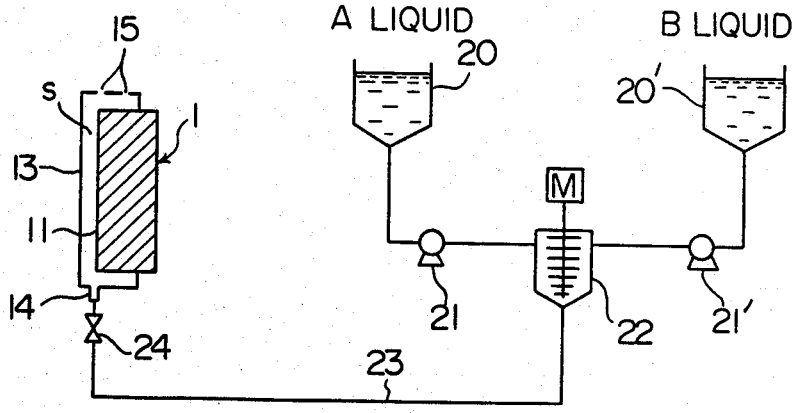

FIG. 1 is a plan view of one embodiment of the tie involving present invention, FIG. 2 is a section of the embodiment of FIG. 1, cut along the line A—A, FIG. 3 is a section of the embodiment of FIG. 1, cut along the line B—B, FIG. 4 is a verical section illustrating the Danchoku tie of this invention as temporarily laid on the understructure of railway track, FIG. 5 is a vertical section illustarting the Danchoku tie of this invention as laid under the railway track, FIG. 6 is a perspective view illustrating the mold fit on the concrete tie body in accordance with the present invention, FIG. 7 is a section of the embodiment of FIG. 6, cut along the line A—A, FIG. 8 is a flow sheet showing production steps of the Danchoku tie in accordance with the present invention, and FIG. 9 is an enlarged section of a portion of the mold around its deaeration holes.

As shown in FIGS. 1–3, the tie involving present invention is composed basically of the structure of a concrete tie body 1 for supporting rail, with its lower portion adhered and coated with a microcellular polyurethane elastomer coating layer 2, together forming an integral body.

In throughout the present specification and claims, the surface of the tie on which the rail is laid will be referred to as "top", the surface opposite thereto, as "bottom", and all other surfaces, as "sides".

The coating layer 2 coats the entire bottom and the lower portions of the sides of the concrete tie body, as shown in FIGS. 2 and 3. In that occasion, the height h of the coating layers on the sides is not particularly limited, but can be varied over a wide range depending on the intended utility of the Danchoku tie (for high-speed railway, ordinary railway, subway, etc.). Normally, however, the height h is advantageously from 1/20 to 1/1, preferably ¼–¾, inter alia, ½–3/5, of the height H of the concrete tie body. And, for the ordinary concrete tie body having an H of 8–30 cm, recommendably the height h of coating is 4–18 cm.

The thickness as w, w' of the coating layer 2 neither are limited, but are variable over a wide range depending on such factors as the intended utility of Danchoku tie. It is generally desirable, however, that it should be at least 8 mm. The upper limit of the thickness is not critical, but generally that of 50 mm or less is sufficient, as too thick a coating layer is expensive and does not show advantages to justify the cost increase. Thus, the coating layer 2 normally can have a thickness of 10–35 mm, preferably 15–30 mm. Within said range, the thickness of coating layer 2 may be same at the bottom and at the sides, but the thickness w' at the sides subject to less load may be less than the thickness w of the coating at the bottom of the tie, e.g., w may range 15–50 mm, preferably 20–30 mm, w' 5–50 mm, preferably 18–29 mm, and w–w', 1–10 mm.

The size of concrete tie body to be coated with such a coating layer is variable depending on the intended use of the tie, but normally it is 50–1000 cm in width, 200–280 cm in length and 10–30 cm in height.

The most characteristic feature of the tie involving present invention resides in the provision of at least two through-holes 3, 3', 3''. . . for bolting bored vertically through the concrete tie body 1 and coating layer 2 of Danchoku tie as described above, and of nuts 4 fittable with the bolts, which are buried in the through-hole portions of the concrete tie body 1.

As illustrated in FIG. 4, into each of the through-holes 3, 3', 3''. . . for insertion of bolts, holding bolts 6, 6', 6''. . . are screwed, to pierce through the tie. By the adjustment of these holding bolts, the three-dimensional position of the tie can be determined to lay the tie at the desired height with desired inclination of its top, with high precision and easy operation.

Such through-holes may be bored, as illustrated in FIG. 1, one each in the vicinity of the two ends of one edge of concrete tie body 1 as 3 and 3'', and one at the center, in the vicinity of the opposite edge, as 3', three in total. Or, as shown with dotted line in FIG. 1, instead of boring one hole 3' at the center of the portion near the other edge, two holes 3''', 3'''' may be bored at the corresponding positions to those of the holes 3, 3'' on said edge, making the total number of through-holes four.

The size of the through-holes is determine depending on the thickness of holding bolt to be inserted thereinto, while advantageously the diameter of 10–40 mm, preferably 20–30 mm is normally selected.

It is permissible to form a depression at the center of downmost portion of the bottom of the coating layer 2 composed of the microcellular polyurethane elastomer which is subject to less load, as shown in FIGS. 2 and 3, and to fit into said depression, a soft synthetic resin foam 5 which is cheaper than the microcellular polyurethane elastomer. This enables to avoid the central reaction which poses a problem in the strength property of tie body, and to save the consumption of expensive microcellular polyurethane elastomer. As synthetic resin foams useful for this purpose, closed cell type crosslinked polyethylene foams having an apparent density of normally 0.01–0.1, preferably 0.02–0.05 are particularly suitable.

The length of said depression (t in FIG. 2) normally ranges $\frac{1}{4}$–$\frac{1}{2}$ of the length L of conrete tie body, preferably $\frac{1}{4}$–$\frac{1}{3}$. Within said range the length t is suitably variable. Also the depth (d in FIG. 2) of the depression may range 1/10–1/1, particularly $\frac{1}{2}$–7/10, of the thickness w of the coating layer 2 at the bottom. It is advantageous that the depression should be formed over the entire width direction of coating layer 2, as shown in FIG. 3.

The Danchoku tie involving this invention having the above-described structure can be laid under railway tracks in the manner described hereinbelow, as illustrated in FIGS. 4 and 5.

Namely, holding bolts 6, 6', 6''. . . are fitted with the nuts 4 buried in the through-holes 3, 3', 3''. . . vertically piercing through the Danchoku tie involving this invention, as bored in the concrete tie body 1, in such a manner that the lower ends of these bolts should project out of the coating layer 2 of the tie at the bottom. The lower ends of the bolts are placed in the concrete crib 7 constructed on the under-structure of the railway track, and by adjusting each bolt, the level and inclination of the top of tie body 1 can be determined (see FIG. 4).

Then on the top of concrete body 1, rails 8, 8' are fastened in accordance with the accepted practice, and into the spaces between the concrete crib 7 on the under-structure and the coating layer 2 at the lower portion of the concrete tie, grouting concrete is poured to form the solid bed 9. Before this concrete is fully cured, the holding bolts 6, 6', 6''. . . are removed, and onto the tops of the through-holes 3, 3', 3'', . . . caps made of an elastomer, 10, 10', 10''. . . are fitted (see FIG. 5).

The tie involving this invention thus having the holding bolts 6, 6', 6''. . . screwed into and piercing through the through-holes 3, 3', 3''. . . vertically extending therethrough, by adjusting said bolts, the three-dimensional position of the tie as will give the desired level and inclination of top surface thereof can be determined. Accordingly it becomes possible to lay the railway track very precisely through easy operations.

In pouring the concrete, care should be taken that the concrete should not flow into the through-holes to directly connect the concrete tie body 1 with the bed 9. Because, should they be directly connected, the vibration of concrete tie body 1 is directly transmitted to the bed 9, and cannot be absorbed and buffered at the coating layer 2. Therefore, it is important to keep the hole size, at least at the lower coating layer portion, at about the same or only slightly greater than the thickness of the bolt to be inserted thereinto, to substantially prevent the concrete from flowing into the hole.

From the same reason, the concrete for making the bed should not rise over the upper edges of the coating layer 2 at the sides of the tie, to be directly connected with the concrete tie body 1 (see FIG. 5).

In short, it is very important that the concrete tie body 1 be substantially completely isolated from the concrete bed 9.

One of the characteristic features of Danchoku tie involving this invention is the use of specific microcellular polyurethane foam as the material for making the coating layer.

That is, the present inventors discovered that microcellular polyurethane elastomers are well suited as the coating material for Danchoku tie, which can exhibit vibration-isolating effect at the position intervening the concrete tie body and roadbed as well as the grouting concrete serving as the solid bed, because of the energy loss effect, etc. based on their viscoelasticity characteristics. Whereupon the present invention was completed. According to the present invention, the spring constant of Danchoku tie can be reduced to equal or even below that of the ballasted track, on rigid roadbed such as high level bridge, by a suitably selecting soft polyurethane elastomer, and whereby the vibration and noise caused by train running can be effectively isolated. Furthermore, by the use of a microcellular polyurethane elastomer, it is made possible that even when the elastomeric coating material is confined by the grouting concrete serving as the solid bed, the marked reduction in the vibration-isolating effect due to the increase in spring constant can be prevented, as such an elastomer can be internally freely deformed.

The microcellular polyurethane elastomer to be used in the present invention normally has a bulk density within the range of 0.4–0.75 g/cm$^3$, preferably 0.55–0.7 g/cm$^3$.

The physical and chemical properties of polyurethane elastomers other than the bulk density can be varied over broad ranges by the selection of constituents but for the specific purpose of isolation of vibration as in the present invention, naturally the optimum constituent must be selected so as to attain the desired durability and vibration-isolating characteristics. Hereinafter the composition of the polyurethane elastomer suitable for the purpose of this invention will be explained in detail.

The microcellular polyurethane elastomer to be used in this invention is formed from a specific starting foamable liquid of urethane elastomer composed of (a) polyether polyol, (b) vinyl monomer-grafted polyol, (c) liquid polybutadiene polyol, (d) organic polyisocyanate, (e) chainextender, (f) blowing agent and (g) urethanation catalyst.

The polyether polyol (a) to be used as one of the polyol components in the preparation of the polyurethane elastomer according to the present invention has an average number of functional groups of 2.5–4.5, and a number average molecular weight of 2000–8500. When the average number of functional groups in the employed polyether polyol is less than 2.5, the foamed urethane elastomer obtained therefrom shows increased permanent compression set. Conversely when the average number of functional groups exceeds 4.5, the resulting elastomer shows a tendency to become harder, and furthermore the possibility of its rupture increases when it is exposed to the vibratory compression. Thus, the preferred average number of functional groups is 2.5–4.5, particularly 2.8–4.0.

Again, when the number average molecular weight of the polyether polyol (a) is less than 2,000, a foamed polyurethane elastomer having a high vibration energy-absorbing characteristics can hardly be obtained. Conversely, when it exceeds 8,500, the resulting polyurethane elastomer shows degradation in its elastic properties, tends to produce plastic deformation, and shows a strong tendency particularly for increased permanent compression set. Thus it is desirable for the polyether polyol to be used in the present invention to have the number average molecular weight normally ranging from 2000–8500, particularly 3000–6500.

As such polyether polyol (a), those normally used in the preparation of polyurethane elastomers can be optionally used. More specifically, such polyether polyols obtained by addition-polymerizing $C_2$–$C_4$ lower alkylene oxides, such as ethylene oxide, propylene oxide, etc. to $C_2$–$C_6$ aliphatic polyhydric alcohols such as glycerin, trimethylolpropane, etc. or to active hydrogen-containing compounds having active hydrogen atoms such as ethylenediamine, diaminodiphenylmethane, etc. may be named. Typical examples of such polyether polyols (a) include glycerin/propylene oxide/ethylene oxide copolymerized adduct (average number of functional groups =3.0, number average molecular weight =3000), propylene glycol/propylene oxide/ethylene oxide copolymerized adduct (average number of functional groups =2.0, number average molecular weight =4800), glycerin/pentaerythritol/propylene oxide/ethylene oxide copolymerized adduct (average number of functional groups =3.7, number average molecular weight =5700), etc.

One of the characteristic features of the present invention resides in that, in combination with the above polyether polyol (a), a vinyl monomer-grafted polyol (b) having an average number of functional groups of 2.5–4.0 and the graft ratio of 4–20% by weight, and a liquid polybutadiene polyol (c) having an average number of functional groups of 2.0–3.0, a number average molecular weight of 2000–7000, and hydroxyl terminal group(s), are used as the polyol component for composing the foamed polyurethane elastomer.

The "vinyl monomer-grafted polyols" to be used in the present invention (hereinafter may be referred to as the graft polyols) (b) signifies modified polyols prepared by in situ radical polymerization of vinyl monomers in the presence of ordinary polyols, which per se are known as the polyol component for producing high elasticity urethane foams (e.g., Japanese Patent No. 447628, U.S. Pat. No. 3,033,841, U. K. Pat. No. 874130, German Pat. Nos. 1077430, 1105179, 1081917, and 1111394, Laid-open Japanese Patent Publication No. 93729/81). According to the invention, of such graft polyols, particularly those specific graft polyols having an average number of functional groups of 2.5–4.0 and a graft ratio of 4–20% by weight are used.

When the average number of functional groups of the graft polyol employed is less than 2.5, the resulting microcellular polyurethane elastomer shows excessively great permanent compression set, and therefore is not appropriate. Conversely, when it exceeds 4.0, the product urethane elastomer shows a tendency to be hardened. The preferred range of the average number of functional groups of the graft polyol is 2.5–3.0. Again, when the graft ratio of the graft polyol is less than 4% by weight, permanent compression set is aggravated. Conversely, when it exceeds 20% by weight, the viscosity of the liquid rises to markedly deteriorate the moldability. Thus it is convenient that the graft ratio of graft polyol ranges 4–20% by weight, particularly 5–15% by weight. The term "graft ratio" used herein means, of the total vinyl monomer added, the ratio of the vinyl monomer graft polymerized to the polyol, to the weight of said polyol.

As the polyols to serve as the trunks of such graft polyols (b), those having a number average molecular weight of 2500–8500, preferably 4000–7000, and a hydroxyl value of 20–67, preferably 24–50, are advantageously used. For instance, polyalkyleneether glycol having a number average molecular weight of 4800, which is obtained by addition polymerizing ethylene oxide and/or propylene oxide to glycerin, may be used.

As the vinyl monomers to be grafted to these polyols, the following may be named for example: olefins such as styrene, vinyltoluene, 1-butene, 2-hexene, 1,4-hexadiene, 1,3-butadiene and 3-pentene; vinyl halides such as vinyl chloride and vinylidene chloride; ethylenic unsaturated carboxylic acids, such as acrylic acid and methacrylic acid, or their derivatives (e.g., alkyl esters); vinyl acetate; acrylonitrile; etc. They may be used either singly or in combination of more than one kind of the monomers.

The grafting of the above vinyl monomer or monomers to the above polyol can be achieved by radical polymerizing the vinyl monomer(s) in the presence of the polyol according to the method known per se. As the useful radical polymerization catalyst, for example peroxide-type, azo-type or redox-type polymerization initiators or metal compound catalysts, etc., may be named. Thus obtained graft polyols can normally have the number average molecular weight of 2500–8500, preferably 4000–7000.

As the particularly preferred graft polyols for the present invention, for example, that obtained by graft polymerizing acrylonitrile and styrene to the polypropyleneether glycol having a number average molecular weight of about 5100 and an average number of functional groups of about 3, in an autoclave at 120° C. for 8 hours, using as the polymerization initiator azobisisobutyronitrile, may be named.

"Liquid polybutadiene polyol" (c) signifies liquid butadiene homopolymers or copolymers having terminal reactive hydroxyl groups, particularly allyl-type primary hydroxyl groups, which per se have been known (e.g., see U.S. Pat. Nos. 3,427,366 and 3,674,743). They can be prepared by, for example, radical addition polymerizing 1,3-butadiene alone or 1,3-butadiene and no more than 75% by weight of the total monomer of $C_2$–$C_{12}$ ethylenically unsaturated monomers such as styrene, acrylonitrile, vinyl acetate, etc., in the presence of hydrogen peroxide as the polymerization catalyst.

According to the present invention, of such liquid polybutadiene polyols, particularly those having an average number of functional groups of 2.0–3.0 and a number average molecular weight of 2000–7000 are used. When the average number of functional groups in the liquid polybutadiene polyol employed is less than 2.0, product of high spring constant is difficult to be obtained. The product furthermore shows a tendency to have larger permanent compression set. Also the miscibility thereof with the polymer polyol (a) and graft polyol (b) to be used as mixed therewith is impaired, and the moldability becomes markedly poor. Conversely, when it exceeds 3.0, the product lacks elasticity, becomes brittle, is void of improvement in waterproofness and alkali resistance, and shows markedly depressed fatigue resistance.

Thus the convenient average number of functional groups of the liquid polybutadiene polyol (c) is within the range of 2.0–3.0, particularly 2.1–2.8. Again, when the number average molecular weight of the liquid polybutadiene polyol is less than 2,000, the variations in strength and elongation used as the norm of waterproofness and alkali resistance are markedly increased, and the fatigue resistance and permanent compression set show strong tendency for marked degradation, and the closed cell-forming ability is reduced. On the other hand, when it exceeds 7,000, the viscosity of the liquid becomes excessively high, impairing its blendability with polyisocyanate (d). Thus the product elastomer exhibits not only low tensile strength, but fails to have a high spring constant, and shows poor closed-cell-forming ability. Thus it is appropriate for the liquid polybutadiene polyol to have a number average molecular weight of 2000–7000, preferably 2400–5000.

Furthermore, it is desirable that the liquid polybutadiene polyol (c) to normally have a hydroxyl content of 0.5–1.0 milliequivalent/gram, and an iodine value of 400–500.

As the particularly preferred liquid polybutadiene polyol, for example, a hydroxyl-terminated butadiene homopolymer having an average number of functional groups of 2.2–2.4 and a number average molecular weight of about 2,800 (e.g., poly bd R-45 HT manufactured by ARCO Chemical Co.), a hydroxyl-terminated butadiene/styrene copolymer having an average number of functional groups of 2.2–2.4 and a number average molecular weight of about 3,500 (e.g., poly bd CS-15 manufactured by ARCO Chemical Co.), and a hydroxyl-terminated butadiene/acrylonitrile copolymer having an average number of functional groups of 2.5–2.8 and a number average molecular weight of about 4450 (e.g., poly bd CN-15 manufactured by ARCO Chemical Co.) may be named.

The blend ratio of the above-mentioned three types of polyol components (a), (b) and (c) is variable over a wide range, according to the physical properties required for the ultimately produced urethane elastomer. Normally, it is convenient to select the blend ratio from the below-specified ranges, based on the total weight of the three components (a), (b) and (c).

| Polyol component | Normal range (wt %) | Preferred range (wt %) | Optimum range (wt %) |
|---|---|---|---|
| (a) | 15–95 | 20–95 | 50–90 |
| (b) | 1–60 | 1.5–40 | 2–30 |
| (c) | 1–50 | 2–40 | 3–30 |

Also the mixing ratio of the graft polyol (b) to the polybutadiene polyol (c), (b)/(c) by weight, is normally from 1/0.5 to 1/1.5, preferably from 1/0.8 to 1/1.2. The mixing ratio of the polyether polyol (a) to the polybutadiene polyol, (a)/(c) by weight, is advantageously within the range of 3/1–15/1, preferably 4/1–10/1.

The urethane elastomer obtained by the concurrent use of vinyl monomer-grafted polyol (b) and liquid polybutadiene polyol (c) in accordance with the present invention is found to achieve the novel effects unattainable with conventional elastomers, i.e., it gives a high spring constant, showing no degradation in tensile strength due to decrease in bulk density, even under the conditions of high loads and restricted deformation such as in the use for Danchoku ties, and furthermore its permanent compression set is small, and its variations in strength and elongation shown in the waterproofness and alkali resistance tests are small.

Preferred combination of the graft polyol (b) and the liquid polybutadiene polyol (c) for achieving the high quality closed cells, low variations in strength and elongation in the waterproofness and alkali resistance tests, excellent vibration-absorbing ability and appropriate spring constant and elongation, which are obtained as the novel, synergistic effect characteristic to the present invention, is that of the graft polyol having a graft ratio of 10–15%, a number average molecular weight of 5000–7000 Iand an average number of functional groups of 3.0–3.8, with the liquid polybutadiene polyol having a number average molecular weight of 2500–4800 and an average number of functional groups of 2.2–2.8, at a blend ratio of (b) to (c) within 1:0.5 to 1:1.5, particularly 1:0.8 to 1:1.2. Furthermore, the best synergistic effect is obtained when the above liquid polybutadiene polyol is blended in an amount of 3–30% by weight based on the total weight of the three types of polyol components (a), (b) and (c).

As the organic polyisocyanate (d) to be reacted with the above polyol components (a), (b) and (c), any of those normally used for the production of urethane elastomers can be used. Examples are such polyisocyanates as 4,4'-diphenylmethanediisocyanate (M.D.I.), naphthylenediisocyanate, tolylenediisocyanate and hexamethylenediisocyanate, which may be used either alone or in combination. The polyisocyanate (d) may also be used in the form of a precursor obtained by advance condensation with aforesaid polyhydric alcohol, i.e., a pre-polymer or a semi-pre-polymer.

In either case, the amount of the organic polyisocyanate (d) is variable within the range around stoichiometric equivalent to the total active hydrogen-containing components (polyol components, chain extender, etc.) which are to react with the isocyanate residual groups (—NCO) present in the foamable starting liquid of urethane elastomer, ±10%, i.e., in terms of NCO index, within the range of 90–110, preferably 95–105.

The chain extender (e) to be used for the formation of polyurethane elastomer in the present invention reacts with the organic polyisocyanate (d) to form, by means of a urethane bond or a urea bond, a hard segment that is principally an inter-hydrogen bond. It is thus an important factor controlling the elasticity characteristics of the product polyurethane elastomer. According to the invention, relatively low molecular weight, substantially difunctional active hydrogen-containing compounds are advantageously used as the chain extender. Examples of such a chain extender (e) includes $C_2$–$C_{10}$ diols such as ethylene glycol, propylene glycol, propanediol, butanediol, hydroquinone and hydroxyethylquinone ether; and amines such as methylenebis(o-chloroaniline), quadrol, ethylenediamine and triethanolamine. They may be used either alone or in combination.

According to our studies, in the combined use of the chain extender (e) with aforesaid polyol components (a), (b) and (c), it is found appropriate to use the chain extender (e) at a concentration within the range of $0.3\times10^{-3}$ mol/g to $1.5\times10^{-3}$ mol/g, based on the total amount of the five components of (a), (b), (c), (d) and (e). At a concentration lower than that, the chain-extending effect is insufficient, and the resulting foamed polyurethane elastomer generally shows the tendency to have low strength. Conversely, at the chain extender concentration higher than $1.5\times10^{-3}$ mol/g, inter-hydrogen bonds increases excessively, and as the result the resulting elastomer tends to become very hard, although is improved in strength. Such is rather undesirable for the product's utility as in the present invention, wherein the product is exposed to permanent compression set and repetitive compression stress. The preferred concentration range of the chain extender is thus from $0.5\times10^{-3}$ mol/g to $1.2\times10^{-3}$ mol/g As the urethanation catalyst (g), any of those normally used in urethanation reaction, for example, tertiary amine compounds, organometal compounds, etc. may be used. Specific examples include triethylenediamine, diazabicycloundecene, n-methylmorpholine, N,N-dimethylethanolamine; tin octylate and dibutyl tin laurate. The amount of the catalyst is not critical, which is variable over a wide range depending on the desired reaction rate. It needs be suitably adjusted, however, according to the degree of foaming in the urethane elastomer and ambient conditions (temperature, humidity, etc.). Adjustment of the amount of catalyst has been routine practice in the art, and the selection of suitable amount should be easy.

According to the present invention, foamed polyurethane elastomers are used. As the blowing agent (f) to be used for the production of the foamed bodies, conventional blowing agents, such as water and halogenated hydrocarbons (e.g., trichlorofluoromethane, methylene chloride, etc.) may be used. Although the degree of foaming of the urethane elastomer desired in the present invention is not strictly limited, it is important that the product should be relatively lowly foamed compared with ordinary urethane foams. Normally it is advantageous to achieve the degree of foaming, as expressed in terms of bulk density, ranging from 0.4–0.75 g/cm$^3$, preferably 0.55–0.7 g/cm$^3$. The amount of the blowing agent (f) and/or the degree of foaming ca be regulated to make the bulk density of the resulting urethane elastomer a value within the above-specified range.

Besides the foregoing, the starting foamable liquid of urethane elastomer in accordance with the present invention may contain, if required, a foam stabilizer (e.g., silicone surfactant), pigment(s) (e.g., carbon black, titanium oxide, etc.), dyes (e.g., Indanthrene dyes), other fillers (e.g., coal tar, inorganic or organic staple fibers such as glass fiber, asbestos fiber, nylon filer, vinyl chloride fiber, polyester fiber, acrylic fiber, natural or synthesized rubber powder; siliceous sand, etc.).

For the microcellular polyurethane elastomer to be used in this invention to function as a vibration isolator; its spring constant per the unit area is desirably about 0.2 ton/cm/100 cm$^2$ or higher, particularly within the range of 0.7 ton/cm/100 cm$^2$–2 tons/cm/100 cm$^2$. The spring constant within said range can be obtained with the microcellular polyurethane elastomer having a thickness of 5 to 100 mm, the thickness normally employed for a vibration-isolating layer, by suitably selecting its composition and bulk density.

The microcellular polyurethane elastomer coating material exhibits excellent effects when it is integrally shaped with the concret tie body and foamed and intimately adhered thereto. Or, its vibration-isolating effect can be effectively exhibited by shaping it separately from the concrete tie body and then adhering it to said body. That is, the coating layer may be adhered to the lower portion of the concrete tie body with an adhesive, or a box-type polyurethane elastomer shaped body may be formed in advance and into which the concrete tie body may be inserted.

According to the present invention, however, it is found that the most preferred embodiment for forming the coating layer comprises injecting a raw liquid for making the polyurethane elastomer around the lower portion of the concrete tie body in a box of a fixed size, and foaming the liquid to cause an integral shaping and foaming thereof with the tie body, to cause the former to adhere and coat the latter.

And, according to another aspect of the present invention, a process for manufacturing a Danchoku tie is provided, which comprises fixing a concrete tie body in a mold in such a manner that the bottom and at least the lower portion of sides thereof are substantially completely encased in the mold leaving a certain space from the bottom and each of side walls, injecting into said space a foamable starting liquid of polyurethane elastomer of the aforesaid composition, and foaming and curing said starting liquid to integrally form a Danchoku tie coated with a microcellular polyurethane elastomer firmly adhered to the lower portion of the tie body.

According to the process of this invention as above-described, it is possible to make the Danchoku tie with ease, using an atmospheric injection type simple mold, and furthermore the shaped product can be released from the mold after about 2 hours from the injection which requires only about 1 minute. Thus the production efficiency can be drastically increased. Furthermore because in the Danchoku tie prepared in accordance with the subject integral shaping method the concrete tie body and the polyurethane elastomer coating material strongly adhere to each other, use of an adhering primer is unnecessary and hardly any peeling takes place.

According to the process of present invention, the aforesaid components of the starting foamable liquid of polyurethane elastomer are intimately mixed immediately before the injection in accordance with the accepted practice, and injected into the mold for the integral shaping of the Danchoku tie. The mold is fixed to the concrete tie body in such a manner that the bottom and at least the lower portion of the sides (the portions near the bottom) of the tie body should be substantially completely encased by the mold leaving a certain space therebetween, so as to enable the integral shaping of the Danchoku tie. One specific embodiment of mixing means is illustrated in FIGS. 6 and 7. As shown in FIGS. 6 and 7, a box-type mold 13 is attached to the concrete tie body 1 in such a manner that the bottom 11 and the lower portion of sides 12 of the body 1 can be substantially completely encased thereby. In that occasion, spaces s of the width w and w' are provided between respectively the bottom 11 of body 1 and the internal bottom surface of the mold and between the sides 12 of body 1 and the respective internal sides of the mold, w and w' corresponding to the required thicknesses of the coating layer. The mold 13 must be capable of encasing the concrete tie body 1 substantially completely so as to substantially prevent leakage of the starting polyurethane elastomer liquid which is to be injected into the space s. In the mold, projections are formed at the locations corresponding to the through-holes 3, 3', 3''. . . in the concrete tie body so as to form the through-holes also in the coating layer.

The height h with which the mold 13 encases the sides 12 of concrete body 1 is made the same with the height h of the coating layer covering the sides 12 of body 1.

After the mold is set as above, a starting foamable liquid of polyurethane elastomer is injected into the space s through an injection inlet 14 provided at a suitable position of the mold 13. According to the studies of present inventors, the injection can be performed most advantageously when the concrete tie body combined with the mold 13 is given such a posture that, referring to FIG. 6, the side of the mold provided with the injection inlet 14 becomes the downside and the side of the mold having the deaeration holes 15 comes to the top, so that the bottom 11 stands substantially perpendicularly.

FIG. 8 is a flow sheet showing the injection operation of such a starting foamble liquid of polyurethane elastomer into the mold 13. The concrete tie body 1 mounted with the mold 13 is placed with its bottom 11 standing nearly perpendicularly as aforesaid, and the starting liquid is injected through the inlet 14 located at a lower portion of the mold 13. As the injection progresses, the air in the space s is driven out of the deaeration holes 15.

This starting foamabl liquid of polyurethane elastomer can be formulated, for example, by separately feeding a liquid A composed of a polyether polyol, graft polyol, liquid polybutadiene polyol, chain extender, blowing agent, urethanation catalyst and a foam stailizer, etc., and a liquid B composed of organic polyisocyanate into respectively the tanks 20 and 20', and therefrom supplying them via measuring pumps 21 and 21', respectively, into the two-liquids blender 22 and whereat intimately mixing the two liquids. The liquid mixture is then led to the injection inlet 14 through the conduit 23 having a terminal valve 24.

The typical compositions of the liquids A and B conveniently used in the present invention are as follows.

| Composition of liquid A | Parts by weight |
|---|---|
| Polyether polyol (glycerin/propylene oxide/ ethylene oxide copolymerized adduct average number of functional groups: 3-4 number average molecular weight: 2,000-7,000). | 100 |
| Graft polyol [a polymer polyol obtained by graft polymerizing acrylonitrile and styrene to glycerin/propylene oxide/ ethylene oxide copolymerized adduct (number average molecular weight = 5100), in the presence of azobisisobutyronitrile (polymerization initiator); average number of functional groups = 3 graft ratio = 10% number average molecular weight = 6000] | 10-40 |
| Liquid hydroxyl-terminated polybutadine polyol | 5-20 |
| Ethylene glycol | 5-15 |
| Water | 1.0-1.5 |
| Triethylenediamine | 0.5-2.0 |

| Composition of liquid B | NCO index |
|---|---|
| Polyisocyanate polyol prepolymer [e.g. an isocyanate-terminated precursory precondensation product of 4,4'-diphenylmethanediisocyanate with glycerin/propylene oxide/ ethylene oxide copolymerized adduct (number average molecular weight = 6500, average number of functional groups = 3); free NCO content = 16 wt %] | 90-110 |

The injection of the foamable starting liquid of polyurethane elastomer into the mold can be performed at a rate of normally 1-100 kg/min; preferably 30-60 kg/min. The amount to be injected may be varied within the range of ⅓ to 9/10 of the total volume of aforesaid space in the mold, depending on the desired degree of foaming. The injected foamable starting liquid of polyurethane elastomer is then foamed and cured. The foaming and curing can normally be performed at room temperature, but if necessary it may be performed under heating to a temperature of up to about 70° C. The foaming and curing terminates normally within 1-2 hours, and whereupon the mold is detouched from the concrete tie body.

Then a Danchoku tie coated with a microcellular polyurethane elastomer can be obtained. The cells in the microcellular polyurethane elastomer coating shaped integrally with the concrete tie body are predominantly closed cells. The physical property desirably to be had by the elastomer are as follows:

(1) Bulk density: 0.4-0.75 g/cm$^3$, preferably 0.55-0.7 g/cm$^3$
(2) Permanent compression set: not more than 15%, preferably not more than 5%
(3) Spring constant: at least 0.2 ton/cm/100 cm$^2$, preferably 0.7-2 tons/cm/100 cm$^2$,
(4) Tensile strength: at least 5.0 kg/cm$^2$, preferably at least 10 kg/cm$^2$
(5) Elongation: at least 100%,
(6) Waterproofness:
within ±20% in variation of tensile strength, preferably ±10%;
within ±20% in variation of elongation, preferably ±10%
(7) Alkali resistance:
within ±20% in variation of tensile strength, preferably +10%;
within ±20% in variation of elongation, preferably +10%
(8) Fatigue resistance: the amount of permanent deformation not more than 1.0 mm, preferably not more than 0.2 mm
(9) Closed cell forming ratio: at least 90%, preferably 99-100%

The Danchoku tie manufactured by the subject process as above is composed of a concrete tie body 1 and a microcellular polyurethane elastomer coating material 2 adhered to the lower portion of said body 1 by the integral shaping, as illustrated in FIGS. 1-3.

According to the studies of present inventors, it is found very convenient for ready release of the Danchoku tie from the mold, that the deaeration holes 15 of the mold 13 each is given a cross-sectional shape of an inverse circular truncated corn spreading outwards as shown in FIG. 9. As the tapering angle $\alpha$ of the internal wall of each deaeration hole, that of 30°-60° is normally suitable, particularly around 45°. The inner diameter x of the deaeration hole 15 in the mold 13 can be approximately 1-3 mm, and the length y of the cylindrical portion of said hole in the mold is preferably about 0.3–2 mm.

The Danchoku tie involving present invention as above-described exhibits excellent vibration-isolating effect, and can drastically reduce the vibration and noise when used as the ties for railway track for high-speed trains, contributing to alleviate environmental pollution caused by noise and vibration along railway lines.

Furthermore, the Danchoku ties involving present invention can be laid with high precision and easy operations in the track-laying work, leading to marked reduction in labor cost and work period.

Furthermore, according to the preferred embodiment of the process of this invention, the microcellular polyurethane elastomer coating material is integrally foamed and shaped with the concrete tie body, which advantageously brings about the strong adhesion of the coating to the concrete tie body. This high adherability is indeed a great practical advantage, as normally a vibration isolator is required to transmit the movements of the vibration source with certainty, to cut off the vibrations and absorb them within the isolator.

Still in addition, according to the present invention the Danchoku ties (resilient-coated ties) can be easily manufactured using a relatively simple apparatus, and therefore fore the cost and energy consumption for the production can be decreased.

Hereinafter the subject Danchoku ties and the process for their production will be further explained with reference to the working examples.

EXAMPLE

A 400 mm×2,000 mm×200 mm concrete tie body 1 is set in a mold 13 having deaeration holes 15 of x = 1.5 mmϕ, in the manner illustrated in FIG. 6. The thickness of the coating layer (w, w') was 25 mm. Although not shown in FIG. 6, a partition wall was provided in the mold at the part suitable for forming a depression or groove of 300 mm in width and 15 mm in depth at the central portion of the bottom plane of the coating layer, as shown in FIG. 2. Then the liquids A and B of the below-specified compositions were mixed in the stirrer 22 at a rotation rate of 6,000 rpm using the device illustrated in FIG. 8, and the mixture was injected into the space at the lower portion of the mold. Leaving the system for the subsequent 2 hours at room temperature, the tie was parted from the mold. The physical properties of the polyurethane elastomer coating constituting the resultant Danchoku tie are shown hereinbelow, together with the compositions of the liquids A and B.

The physical properties were measured by the below-specified methods.

(1) Bulk density: Measured in accordance with JIS Z 8807, "Method of measurement from volume".

(2) Permanent compression set: Measured in accordance with JIS K 6301 "10, Permanent Compression Set Test".

(3) Spring constant: Measured in accordance with JIS K 6385 "5. Static Spring Constant Test". (A 10 cm×10 cm×2.5 cm test specimen is subjectd to a pressure of up to 425 kg, and the spring constant is determined between 100–400 kg on the load displacement curve.)

(4) Tensile strength and elongation: Measured in accordance with JIS K-6301, with Dumbbell test pieces No. 1 by "3. Methods of Tensile Tests".

(5) Waterproofness: The same Dumbbell test piece No. 1 used in the tensile strength test is immersed in distilled water or ion-exchange water for 96 hours, lightly wiped, and immediately subjected to the tensile strength test. The variation from the value before the aging is thus determined.

(6) Alkali resistance: The same test method as that in above waterproofness is employed except that the immercing liquid is a 1% (caustic potash/caustic soda=1:1) aqueous solution, and the immersing temperature is 50° C.

(7) Fatigue resistance: Measured in accordance with SRIS (Standard Rating of Japan Rubber Association) 3502. (Test conditions are: precompression amount 5 mm, vibration amplitude 4 mm, vibration frequency 5 Hz, repetiton $1\times10^6$ times, and the size of test piece, 50×50×25 mm)

(8) Closed cell foaming property: Measured in accordance with ASTM D 2856-70 A.

EXAMPLE 1

| Composition of liquid A | Parts by weight |
|---|---|
| Polyether polyol (I) (glycerin/propylene oxide/ethylene oxide copolymerized adduct average number of functional groups = 3, number average molecular weight = 3000) | 35 |
| Polyether polyol (II) (glycerin/pentaerythritol/propylene oxide/ethylene oxide copolymerized adduct average number of functional groups = 3.7 number average molecular weight = 5,700) | 40 |
| Graft polyol [a polymer polyol obtained by graft polymerizing acrylonitrile and styrene to glycerin/propylene oxide/ethylene oxide copolymerized adduct (number average molecular weight = 5100), in the presence of azobisisobutyronitrile (polymerization initiator) average number of functional groups = 3 graft ratio = 10% number average molecular weight = 6000] | 15 |
| Hydroxyl-terminated liquid polybutadiene polyol (average number of functional groups = 2.5 number average molecular weight = 2750) | 15 |
| Ethylene glycol | 7 |
| Water | 0.53 |
| Triethylenediamine | 0.7 |

| Composition of liquid B | NCO index |
|---|---|
| Polyisocyanate/polyol prepolymer [isocyanate-terminated precursory condensation product of 4,4'-diphenylmethanediisocyanate and a copolymerized adduct of glycerin/propylene oxide/ethylene oxide having number average molecular weight of 6500 (average number of functional groups = 3), (number average molecular weight = 6500) free NCO content = 16 wt %] | 100 |

Physical properties:
Bulk density: 0.63 g/cm$^3$
Spring constant: 1.5 tf/cm/100 cm$^2$
Permanent compression set: 2.0%
Tensile strength: 13.0 kg/cm$^2$
Elongation: 145%
Waterproofness
Tensile strength variation: −0.9%
Elongation variation: −0.3%
Alkali resistance
Tensile strength variation: −0.3%
Elongation variation: −0.2%
Fatigue resistance: amount of fatigue 0.26 mm
Closed cell foaming property: closed cell forming ratio 100%

EXAMPLE 2

| Composition of liquid A | Parts by weight |
|---|---|
| Polyether polyol (II) (glycerin/pentaerythritol/ propylene oxide/ethylene oxide copolymerized adduct average number of functional groups = 3.7 number average molecular weight = 5700) | 52 |
| Graft polyol [a polymer polyol obtained by graft polymerizing acrylonitrile and styrene to glycerin/propylene oxide/ ethylene oxide copolymerized adduct (number average molecular weight = 5100), in the presence of azobisisobutyronitrile (polymerization initiator); average number of functional groups = 3 graft ratio = 10% number average molecular weight = 6000] | 15 |
| Hydroxyl-terminated liquid polybutadiene homopolyol (average number of functional groups = 2.3 number average molecular weight = 4700 hydroxyl content = 0.5 milliequivalent/g iodine value = 450) | 12 |
| Ethylene glycol | 5.7 |
| Water | 0.48 |
| Triethylenediamine | 0.7 |

| Composition of liquid B | NCO index |
|---|---|
| Polyisocyanate/polyol prepolymer [an isocyanate-terminated precursory condensation product of 4,4'-diphenylmethanediisocyanate and glycerin/propylene oxide/ethylene oxide copolymerized adduct (number average molecular weight = 6500) free NCO content = 16 wt %] | 100 |

Physical properties:
Bulk density: 0.69 g/cm$^3$
Spring constant: 0.98 tf/cm/100 cm$^2$
Permanent compression set: 3.8%
Tensile strength: 14.9 kg/cm$^2$
Elongation: 210%
Waterproofness
Tensile strength variation: −3.7%
Elongation variation: −4.3%
Alkali resistance:
Tensile strength variation: −2.2%
Elongation variation: −4.1%
Fatigue resistance: amount of fatigue, 0.16 mm
Closed-cell foaming property: closed cell forming ratio 99.9%

Figure 10A:
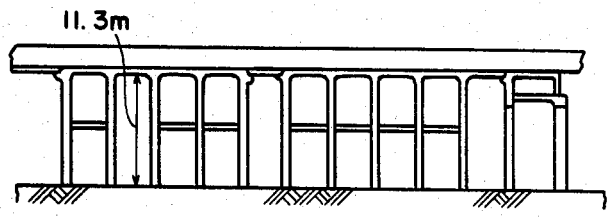
Figure 10A:
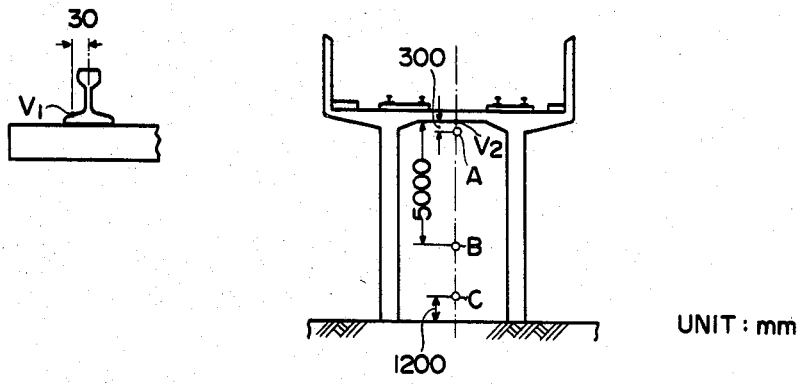

The Danchoku ties prepared in the above Example 1 were laid for the test track as illustrated in FIGS. 10A and 10B, and their effects were measured as follows.

A part of the conventional ballasted track was removed from the test line set on Tohoku Shinkansen before opened to commercial operation, and Danchoku ties of Example 1 were laid over a length of 160 m. The Shinkansen train was used for the test, which was run at a speed of 200–210 km/h.

The vibration and noise caused by the train running on the track were as shown respectively in FIG. 10B, as measured at the two points $V_1$ and $V_2$ (as to vibration) and at the three points of A, B and C (as to noise). The vibration was measured with the baliumtitanate accelerometer and the noise, with the normal sound-meter.

The vibration- and noise-decreasing effects by the test track laid on the Danchoku ties of Example 1 as compared with the conventional ballasted track were as follows:

The vibration at $V_1$ point (acceleration of rail) was nearly equal to that with the resilient ballasted track with ballast-mat, but at $V_2$ point (acceleration of floor slab of elevated structure), it was decreased by 7 dB. At point A (under the floor slab by 0.3 m) the noise was decreased by 7 dB (A), at point B (under the floor slab by 5.0 m) it was decreased by 5 dB(A), and at point (C) (under the elevated structure, 1.2 m high over the ground), by 4 dB(A), as compared with the resilient ballasted track with ballast-mat.

What we claim is:

1. A concrete tie body and a microcellular polyurethane elastomer coating layer which adheres to and coats the lower portion of the tie body to form an integral body therewith, and said microcellular polyurethane elastomer having urethane bonds and a bulk density of 0.4–0.75 g/cm$^3$ and being prepared from the starting foamable liquid of urethane elastomer composed substantially of (a) a polyether polyol having an average number of functional groups of 2.5–4.5 and a number average molecular weight of 2000–8500,
(b) a vinyl monomer-grafted polyol having an average number of functional groups of 2.5–4.0, and the graft ratio of 4–20% by weight,
(c) a liquid polybutadiene polyol having hydroxyl terminal group(s), an average number of functional groups of 2.0–3.0 and a number average molecular weight of 2000–7000,
(d) an organic polyisocyanate,
(e) a chain extender,
(f) a blowing agent, and
(g) a urethanation catalyst, at such ratios that the NCO index is within the range of 90–110, and the concentration of the chain extender, based on the total amount of the five components of (a), (b), (c), (d) and (e), being $0.3\times10^{-3}$ to $1.5\times10^{-3}$ mol/g.

2. The resilient coat of claim 1, in which the polyether polyol (a) has an average number of functional groups of 2.8–4.0, and a number average molecular weight of 3000–6500.

3. The resilient coat of claim 1, in which the polyether polyol (a) is selected from the group consisting of glycerin/propylene oxide/ethylene oxide copolymerized adduct (average number of functional groups =3.0, number average molecular weight =3000), propylene glycol/propylene oxide/ethylene oxide copolymerized adduct (average number of functional groups =2.0, number average molecular weight =4800), and glycerin/pentaerythritol/propylene oxide/ethylene oxide copolymerized adduct (average number of functional groups =3.7, number average molecular weight =5700).

4. The resilient coat of claim 1, in which the vinyl monomer-grafted polyol (b) has an average number of functional groups of 3.0–3.8 and a graft ratio of 5–17% by weight.

5. The resilient coat of claim 1, in which the vinyl monomer-grafted polyol (b) is a polyol having a number average molecular weight of 2500–8500 and a hydroxyl value of 20–67, to which at least one vinyl monomer selected from the group consisting of styrene, vinyltoluene, 1-butene, 2-hexene, 1,4-hexadiene, 1,3-butadiene, 3-pentene, vinyl chloride, vinylidene chloride, acrylic acid or methacrylic acid, their alkyl esters, vinyl acetate and acrylonitrile, is grafted.

6. The resilient coat of claim 1, in which the vinyl monomer-grafted polyol (b) has a number average molecular weight of 4000–7000.

7. The resilient coat of claim 1, in which the vinyl monomer-grafted polyol (b) is the polypropyleneether glycol having a number average molecular weight of about 5100 and an average number of functional groups of about 3, to which acrylonitrile and styrene are grafted.

8. The resilient coat of claim 1, in which the liquid polybutadiene polyol (c) has an average number of functional groups of 2.1–2.8 and a number average molecular weight of 2400–5000.

9. The resilient coat of claim 1, in which the liquid polybutadiene polyol (c) has a hydroxyl content of 0.5–1.0 milliequivalent/g.

10. The resilient coat of claim 1, in which the liquid polybutadiene polyol (c) is selected from the group consisting of hydroxyl-terminated butadiene homopolymer having an average number of functional groups of 2.2–2.4 and a number average molecular weight of about 2800, hydroxyl-terminated butadiene/styrene copolymer having an average number of functional groups of 2.2–2.4 and a number average molecular weight of about 3500, and hydroxyl-terminated butadiene/acrylonitrile copolymer having an average number of functional groups of 2.5–2.8 and a number average molecular weight of about 4500.

11. The resilient coat of claim 1, in which, based on the total weight of the polyol components (a), (b) and (c), 15–95% by weight of the polyether polyol (a), 1–60% by weight of the vinyl monomer-grafted polyol (b), and 1–50% by weight of the liquid polybutadiene polyol (c) ar used.

12. The resilient coat of claim 1, in which the organic polyisocyanate (d) is selected from the group consisting of 4,4+-diphenylmethanediisocyanate, naphthylenediisocyanate, tolylenediisocyanate and hexamethylenediisocyanate.

13. The resilient coat of claim 1, in which the chain extender (e) is selected from the group consisting of ethylene glycol, propylene glycol, propanediol, butanediol, hydroquinone, hydroxyethylquinone ether, methylenebis-(o-dichloroaniline), quadrol, ethylenediamine and triethanolamine.

14. The resilient coat of claim 1, in which the chain extender (e) is contained in the starting foamable liquid at a concentration of, based on the total amount of the five components (a), (b), (c), (d) and (e), $0.5\times10^{-3}$ mol/g$-1.2\times10^{-3}$ mol/g.

15. The resilient coat of claim 1, in which the microcellular polyurethane elastomer has a bulk density of 0.55–0.7 g/cm$^3$.

16. The resilient coat of claim 1, in which the microcellular polyurethane elastomer has a permanent compression set of not higher than 15%.

17. The resilient coat of claim 1, in which the microcellular polyurethane elastomer has a spring constant of not less than 0.2 ton/cm/100 cm$^2$.

18. The resilient coat of claim 2, in which the microcellular polyurethane elastomer has a tensile strength of at least 5.0 kg/cm$^2$ and an elongation of at least 100%.

19. the resilient of claim 1, in which the coating layer has a thickness of at least 8 mm.

20. The resilient coat of claim 1, in which the coating layer has a depressed part at the central portion of its bottom, said depressed part being fitted with a soft synthetic resin foam.

21. The resilient coat of claim 20, in which the synthetic resin foam is a closed cell, cross-linked polyethylene foam.

22. The resilient coat of claim 20 in which said depressed part has a length of ¼ to ½ that of the concrete tie body.

23. The resilient coat of claim 1, in which the coating layer is adhered to, and coats, the lower portion of the concrete tie body, as a result of the steps of injecting from the underside the starting foamable liquid of polyurethane elastomer into a mold encasing the lower portion of said tie body and foaming and curing the liquid in situ.

* * * * *

UNITED STATES PATENT AND TRADEMARK OFFICE

CERTIFICATE OF CORRECTION

PATENT NO. : 4,652,495

DATED : March 24, 1987

INVENTOR(S) : YOSHIHIKO SATO, ET AL.

It is certified that error appears in the above-identified patent and that said Letters Patent is hereby corrected as shown below:

IN THE CLAIMS

Column 20, claim 12, line 7, delete "4,4+-diphenylmethanediisocyanate", insert --4,4'-diphenylmethanediisocyanate--.

Column 20, claim 19, line 33, delete "the" (first occurrence), insert --The--; after "resilient", insert --coat--.

Signed and Sealed this

Eighth Day of September, 1987

*Attest:*

DONALD J. QUIGG

*Attesting Officer*

*Commissioner of Patents and Trademarks*